United States Patent [19]

Jaeger

[11] 4,328,895

[45] May 11, 1982

[54] DISPOSABLE ASH CONTAINER

[76] Inventor: Klara Jaeger, Birkenstrasse 58, Essen 1, Fed. Rep. of Germany

[21] Appl. No.: 802,955

[22] Filed: Jun. 2, 1977

[51] Int. Cl.[3] ..... B65D 73/00; A24D 1/12; A24F 19/00

[52] U.S. Cl. ..... 206/496; 206/484.2; 206/136; 229/3.5 MF; 229/62; 131/231

[58] Field of Search ..... 131/174, 175, 186, 192, 131/202, 207, 219, 231 X, 240 R; 210/484, 489, 490, 492; 229/3.5 MF, 62; 206/484.1 X, 484.2 X, 136, 5, 246, 496, 524.2–524.4

[56] References Cited

U.S. PATENT DOCUMENTS

| | | | |
|---|---|---|---|
| 2,071,394 | 2/1937 | Douglas | 131/20 R |
| 2,116,706 | 5/1938 | Meohas | 131/202 |
| 2,294,848 | 9/1942 | Moore | 229/62 |
| 2,432,656 | 12/1947 | Cook | 131/240 R |
| 2,572,669 | 10/1951 | Sarge et al. | 206/524.2 |
| 2,648,263 | 8/1953 | Richens | 229/58 |
| 3,082,713 | 3/1963 | Elgin | 131/231 |
| 3,372,724 | 3/1968 | Rouse | 131/231 |
| 3,401,702 | 9/1968 | Rossman | 131/240 R |
| 3,447,428 | 6/1969 | Crane | 229/3.5 MF |
| 3,462,070 | 8/1969 | Corella | 229/62 |
| 3,561,670 | 2/1971 | Segal | 229/3.5 MF |

*Primary Examiner*—Herbert F. Ross

[57] ABSTRACT

A container for receiving ashes and cigarette and cigar butts, comprising: a flat-bottomed bag open at the top, made of substantially air-impermeable, plastically deformable, pliable sheet material having at least on its sides defining the interior of the bag a material surface substantially resistant to the embers of cigarette and cigar butts, the bag having a bottom and two confronting identical sidewalls which are joined to one another and to the bottom in a substantially air-tight manner and merge at the open upper end of the bag with a peripheral marginal section, the sidewalls being superimposable on one another at least in the area adjacent the marginal section and being provided at the transition to the peripheral marginal section with a folding line or crease such that the peripheral marginal section can be bent to one side along the crease with plastic deformation of the sheet material, by at least 90° in relation to each of the superimposed areas of the sidewalls, whereby a substantially air-tight closure of the interior of the bag from the environment is formed along the crease.

9 Claims, 4 Drawing Figures

DISPOSABLE ASH CONTAINER

The invention relates generally to ash containers, and especially disposable ash containers, which can be used like ordinary ash trays, and in which the ashes, cigarette and cigar butts or other bad smelling smoker's waste, such as pipe cleaners or the like, can be sealed shut and discarded after use.

BACKGROUND OF THE INVENTION

In the use of open ash trays in enclosed spaces, special problems are encountered with regard to bad odors, and even with regard to health. The bad smell created by cigarettes set down or extinguished in open ash trays is an unreasonable burden, especially on non-smokers, so that the ash trays used by smokers, especially at places of work, have to be emptied after each use and cleaned.

Closable ash trays are known, such as spin-clean ash trays, in which the ash holding means is the surface of a rotatable disk, and cigarette butts and ashes can be spun from the edge of the disk into a receiver chamber located beneath the disk, by actuating a spiral driver connected to the disk. When the operating button is released, a spring returns the disk to its starting position in engagement with an annular shoulder, thereby substantially closing off the receiver chamber. This spin-clean ash tray, however, is expensive, relatively large, hard to clean, and does not close tightly enough. In practice, these ash trays are very seldom empty, and in some cases become so full that the disk can no longer be lowered far enough to discharge the cigarette butts into the receiver chamber. These known closing ash trays are not able in practice to solve the problem of effectively eliminating the bad smell and the health hazard resulting from smoldering cigarette and cigar butts and stale smoke.

THE INVENTION

The invention sets out from the consideration that effective relief from the smoke nuisance and from unsanitary cigarette butts and ashes can be achieved only by means of easily sealed disposable ash containers, which after use can be closed and discarded into a waste container. Such simple operations can easily be undertaken by the smoker for the avoidance of a nuisance to his own sense of smell and health.

It is therefore the general object of the invention to create a cheaply made, single-use ash container.

Furthermore, the ash container of the invention is to be tightly closable in the area of its opening, so that cigarette and cigar butts will be quickly snuffed out due to the lack of oxygen inside the container, and neither smoke smoke nor ashes will be able to escape from the container.

Other aspects of the invention consist in making the ash container able to stand with its opening facing upward, and/or in providing means on the container whereby it can be attached to a suitable surface with its opening facing upward.

Lastly, another aspect of the invention consists in giving the container, like known, open ash trays, a cigarette rest in which a cigarette can be placed and held.

The invention consists in a container for receiving ashes and cigarette and cigar butts, which is especially intended for one-time use, and is constructed in the manner of a flat-bottom bag. This flat-bottom bag consists of plastically deformable and preferably laminated pliable sheet material which is substantially impermeable to air, and which has a material surface, at least on the sides adjacent the interior of the bag, which is substantially resistant to the heat of glowing cigarette and cigar butts. The bag has a bottom which, when the container is used in the manner of an ash tray, can serve simultaneously as a base therefor, and it has also two confronting identical sidewalls which are joined in a substantially air-tight manner to one another and to the bottom, and merge at the open upper end of the bag with a peripheral marginal section, the sidewalls being able to be folded or laid together at least in the area adjacent the lower edge of the marginal section. At the transition from the side walls to the peripheral marginal section, a folding line or crease is provided in accordance with the invention, such that the peripheral marginal section can be bent with plastic deformation of the material along the crease at least 90° to one side in relation to each of the folded, flat areas of the side walls. At the linear fold, which, due to the plastic deformability of the material, remains after the margin is released, forms a virtually air-tight closure, which on the one hand prevents smoke and fumes rising from cigarette butts or ashes from escaping from the interior into the atmosphere, and on the other hand results in a reliable extinction of glowing cigarette or cigar butts which are virtually hermetically sealed within the container.

The form and the manner in which the bag is made is not critical for the invention; conventional bags of various types, such as flat-bottom bags with side gussets, are fundamentally suitable, in which at least two side panels are laid tightly against one another adjacent the top edge and can be folded together to form the closure in accordance with the invention. The material of the bag is pliable, so that the side walls can be folded in, even at the four-ply sections at the folding creases, to form a tight closure.

As stated above, the crease in the ash bag of the invention is embossed or impressed from one side. This means that, of the two sidewalls lying on one another in the area of the fold, one is impressed in the manner of a groove along the fold line on the outside and the other sidewall is raised like a rib on the outside. When the bag is to be closed, the marginal section is turned down toward that side of the bag on which the fold line is groove-like.

The selection of the material facing the interior of the container is important for the invention. It must be sufficiently temperature-insensitive to remain unharmed for a period of time by the burning cigarette butt, even if the material is very thin, e.g., 9 to 12 $\mu$m.

In a preferred embodiment of the invention, a stripe of self-sticking adhesive is applied to the outside of at least one sidewall. This adhesive stripe can be provided with a removable strip of protective material to prevent it from drying out. The container provided with this adhesive stripe can be adhered to the edge of a table, for example, so that its opening is facing upward. In like manner, the disposable ash container can be attached, for example, to the dashboard of motor vehicles within reach of a passenger, and can thus serve in lieu of the car ash tray to receive cigarette butts and other tobacco smoking wastes. This eliminates the burdensome and sometimes complicated removal and cleaning of ash trays installed in the car, inasmuch as the ash container of the invention and the tobacco smoking wastes it contains can be treated as uncritical waste materials and can be discarded into any trash container.

Although the invention is not limited to a particular kind of bag or to its preparation, so that basically any kind of bag, e.g., bags made in one piece or in a plurality of pieces and having rectangular or polygonal bottoms, flat bags, and even tubular bags can be used, the bag form after manufacture should be such that the bag can be folded flat in a space-saving manner, so that the bags of the invention can be offered to the consumer in compact packages containing a plurality of bags.

These and other advantages of the invention will appear in the following description of embodiments of the invention in connection with the drawing, wherein.

Figure 1:
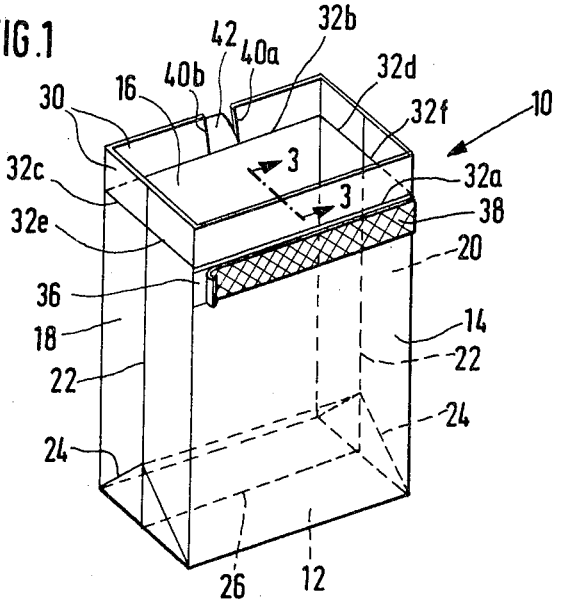
FIG. 1 is a diagrammatic view of an ash container of the invention in the ready-to-use state, i.e., with the top open.
Figure 2:
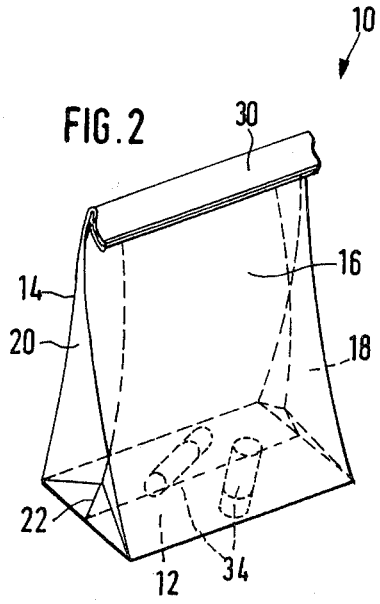
FIG. 2 shows the container of FIG. 1 after the closure thereof.

The container 10 represented diagrammatically in FIGS. 1 and 2 in the open and closed state has the general form of a conventional flat-bottom bag which in the open state represented in FIG. 1 has a box-like external shape. It is to be pointed out that the bag cross section and the shape of the bottom are of only secondary importance to the invention and many other bag cross sections, such as hexagonal or partially rounded cross sections, are suitable.

The bag represented has a rectangular bottom 12, two flat sidewalls 14 and 16 disposed approximately vertically in the opened state shown in FIG. 1, which confront one another and are of congruent profile, and two likewise identical confronting adjoining walls 18 and 12 connecting the two sidewalls 14 and 16 together at their edges. These connecting walls are collapsible along vertical fold lines 22 and diagonal fold lines 24 adjacent the bottom such that the two sidewalls 14 and 16 will lie substantially flat on one another and will be separated from one another only in the outer area by the inwardly folded sections of the connecting walls. In this flatly folded state, the bottom 14 is also folded in at the fold line 26. Flat-bottom bags which are foldable in this manner are known for entirely different purposes, namely for the packing of granular, powdered or also liquid materials.

In the case of the invention, the relatively good heat resistance of certain sheet materials and their plastic deformability are utilized for the formation of an easily closable ash receiving container.

Figure 3A:
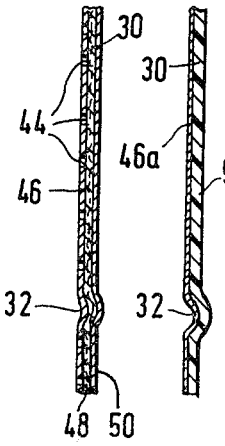
FIGS. 3A and 3B are two enlarged diagrammatic partial cross sections taken along the line 3—3 of FIG. 1 through a portion of the sidewall of the container with different arrangements of the laminations forming the material of the container walls.

The container shown in FIGS. 1 and 2 has a special closure which is formed with the cooperation of a marginal section 30 extending around the container 10 adjacent the mouth thereof. The circumferential margin 30 merges with the portion of sidewalls 14 and 16 and connecting walls 18 below it at a preformed crease or folding line 32 extending about the upper edge of the bag and parallel thereto; when the bag is in the folded state, this crease permits the collapsed upper marginal section 30 to be folded over by more than 90° (FIG. 2). For this purpose the crease 32 is embossed so as to form a raised rib on the outside of one vertical section and a groove on the outside of the other. In the bag 10 of FIG. 1, the crease portions 32*a*, 32*c* and 32*d* are in the form of raised ribs on the outer side of the bag, while the crease portions 32*b*, 32*e* and 32*f* are in the form of grooves on the outer side of the bag. On the inside of the bags the creases have, of course, just the opposite shape. The cross-sectional shape of the circumferential groove 32 can be seen best in FIGS. 3A and 3B, which will be discussed further below.

When the upper section 30 is folded over, the creases 32*a* . . . 32*f* of complementary shape fit together forming a labyrinth packing which hermetically closes off the interior of the container 10 at its opening. Due to the plastic deformation of the container material, the folded marginal portion 30 retains the position represented in FIG. 2, and the cigarette butts which are contained within the container, and which under certain circumstances may still be lit, are shut up and are quickly smothered due to the lack of oxygen.

To the outside surface of sidewall 14, at a point just below the crease portion 32, there is provided a stripe of contact adhesive 36 provided with a removable cover strip 38 to maintain its activity. The cover strip 38 is partially pulled away in the drawing. After the cover strip 38 has been pulled off, the container can be removably fastened by means of the contact adhesive strip 36 to the edge of a table, for example, or to a surface on the dashboard of a motor vehicle. After use, the bag 10 is closed by folding over the marginal section 30, and then it can be pulled away from the surface to which it is attached, and discarded. As shown in the drawing, the adhesive strip should be applied to the flat side or sidewall that will confront the side that is folded down when the closure is shut.

At the upper marginal section 30, two approximately vertical cuts 40*a* and 40*b* are formed, which extend to the crease 32 at a distance apart corresponding approximately to the thickness of a cigarette. The tab 42 remaining between the cuts 40*a* and 40*b* can be turned down approximately 90° at the fold line 32*b* and will then form a rest for supporting a cigarette.

Suitable material for the bag 10 described above is basically any pliable sheet material that is sufficiently heat resistant on at least one side (the inside of the bag) and is not destroyed by embers, which prevents the passage of air from the one face ply to the other, and is sufficiently plastically deformable to assure that it will retain its deformation in the area of the crease 32 after the margin 30 has been turned down. Fundamentally suitable for this purpose is a thin aluminum foil, which can be provided externally with a label to identify it as an ash container. In practice, however, the series of laminations represented diagrammatically in FIGS. 3A and 3B has proven especially good in practice. The wall section represented in cross section in FIG. 3A consists of a total of three layers, namely an aluminum foil of, for example, 9 to 12 μm thickness facing the interior of the bag and provided with holes or discontinuities 44, an adjoining absorbent paper layer 48, and an air-tight outer layer 50 made of aluminum foil, plastic film or impregnated paper. This construction of the sheet material has the advantage that the smoke and fumes produced in the interior of the container are to a very great extent absorbed after they pass through the openings 44 into the absorbent intermediate layer 48. On account of the one-time use of the container, the absorbent paper layer can be made very thin and yet remain fully effective. The discontinuities 44 are produced in an especially simple manner if, instead of an aluminum foil, a coating of aluminum is deposited from vapor or applied by atomization.

Figure 3B:
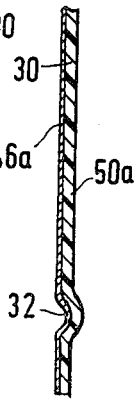

The sheet material represented diagrammatically in FIG. 3B is a two-ply material consisting of a laminate made of aluminum and paper or aluminum and plastic. At least one of the two layers must be air-tight, so that the container formed of this material can be closed in an air-tight manner.

The aluminum layer 46a must always face the interior of the bag. The outer paper or plastic layer should have a surface quality suitable for the printing of legends or trademarks.

While specific materials and details of construction are referred to in connection with the description of the illustrated embodiment, it will be understood that equivalent materials and other details of construction may be resorted to within the spirit of the invention as hereinafter claimed.

I claim:

1. A container for receiving ashes and cigarette and cigar butts, comprising: a flat-bottomed bag open at the top, made of substantially air-impermeable, plastically deformable, pliable sheet material having at least on its sides defining the interior of the bag a material surface substantially resistant to the embers of cigarette and cigar butts, the bag having a bottom adapted to support said container in an upright position on a surface and two confronting sidewalls of substantially the same height which are joined to one another and to the bottom in a substantially air-tight manner and merge at the open upper end of the bag with a peripheral marginal section, the sidewalls being superimposable on one another at least in the area adjacent the marginal section and being provided at the transition to the peripheral marginal section with a folding line or crease such that the peripheral marginal section can be bent to one side along the crease with plastic deformation of the sheet material, by at least 90° in relation to each of the superimposed areas of the sidewalls, whereby a substantially airtight closure of the interior of the bag from the environment is formed along the crease, and two substantially parallel cuts made downwardly from the top edge of the bag approximately to the folding line, and in which the tab of material remaining between the two cuts is adapted to be bent down at the crease for the formation of a cigarette rest.

2. A container for receiving ashes and cigarette and cigar butts, comprising: a flat-bottomed, box-shaped bag open at the top, said bag having a substantially rectangular bottom, two confronting sidewalls which are flat when the bag is in the open state, and two confronting, folding connecting walls adjoining each one edge of each of the flat sidewalls, said bag being made of substantially air-impermeable, plastically deformable, pliable sheet material having at least on its sides defining the interior of the bag a material surface substantially resistant to the embers of cigarette and cigar butts, the bag having a bottom adapted to support said container in an upright position on a surface and two confronting sidewalls of substantially the same height which are joined to one another and to the bottom in a substantially air-tight manner and merge at the open upper end of the bag with a peripheral marginal section, the sidewalls being superimposable on one another at least in the area adjacent the marginal section and being provided at the transition to the peripheral marginal section with a folding line or crease such that the peripheral marginal section can be bent to one side along the crease with plastic deformation of the sheet material, by at least 90° in relation to each of the superimposed areas of the sidewalls, whereby a substantially air-tight closure of the interior of the bag from the environment is formed along the crease, the crease protruding rib-like over the width of the one sidewall and sinking inwardly trough-like in the sections adjoining on both sides up to an approximately vertical folding line in each of the two connecting walls, again protruding rib-like over the remaining width of the two connecting walls up to the adjacent edge of the other sidewall, and being recessed inwardly over the entire width of the other sidewall, so that, upon the turning down of the upper marginal section, after the folding in of the connecting walls, the rounded crease lines of the superimposed wall sections will engage matingly and close the bag air-tight.

3. A container for receiving ashes and cigarette and cigar butts, comprising: a flat-bottomed bag open at the top, made of substantially air-impermeable, plastically deformable, pliable sheet material having at least on its sides defining the interior of the bag a material surface substantially resistant to the embers of cigarette and cigar butts, said pliable sheet material having an aluminum layer facing the bag interior and a paper layer joined thereto, the two layers of the sheet material forming an aluminum-paper laminate, in which the aluminum layer is provided with pores, apertures or discontinuities and the paper has a highly absorbent inner layer with a substantially air-impermeable outer layer, so that the smoke and vapor precipitating in the closed container can be received through the openings or discontinuities of the aluminum layer into the absorbent paper intermediate layer but is unable to penetrate the air-impermeable outer layer, the bag having a bottom adapted to support said container in an upright position on a surface and two confronting sidewalls of substantially the same height which are joined to one another and to the bottom in a substantially air-tight manner and merge at the open upper end of the bag with a peripheral marginal section, the sidewalls being superimposable on one another at least in the area adjacent the marginal section and being provided at the transition to the peripheral marginal section with a folding line or crease such that the peripheral marginal section can be bent to one side along the crease with plastic deformation of the sheet material, by at least 90° in relation to each of the superimposed areas of the sidewalls, whereby a substantially air-tight closure of the interior of the bag from the environment is formed along the crease.

4. A container for receiving ashes and cigarette and cigar butts, comprising: a flat-bottomed bag open at the top, made of substantially air-impermeable, plastically deformable, pliable sheet material having an aluminum layer on its sides defining the interior of the bag so as to be substantially resistant to the embers of cigarette and cigar butts, and a paper layer joined to said aluminum layer, the bag having a bottom adapted to support said container in an upright position on a surface and two confronting sidewalls of substantially the same height which are joined to one another and to the bottom in a substantially air-tight manner and merge at the open upper end of the bag with a peripheral marginal section, the sidewalls being superimposable on one another at least in the area adjacent the marginal section and being provided at the transition to the peripheral marginal section with a folding line or crease such that the peripheral marginal section can be bent to one side along the crease with plastic deformation of the sheet material, by at least 90° in relation to each of the superimposed areas of the sidewalls, whereby a substantially air-tight closure of the interior of the bag from the environment is formed along the crease, two substantially parallel cuts extending downwardly from the top edge of the bag approximately to the folding line, the tab of material remaining between the two cuts being adapted to be bent down at the crease for the formation of a cigarette rest, and adhesives applied to the outside of at least one sidewall for holding the container to a support surface.

5. A container according to claim 4, which is constructed as a flat-bottomed, box-shaped bag having a substantially rectangular bottom, two confronting sidewalls which are flat when the bag is in the open state, and two confronting, folding connecting walls adjoining each one edge of each of the flat sidewalls, the crease protruding rib-like over the width of the one sidewall and sinking inwardly trough-like in the sections adjoining on both sides up to an approximately vertical folding line in each of the two connecting walls, again protruding rib-like over the remaining width of the two connecting walls up to the adjacent edge of the other sidewall, and being recessed inwardly over the entire width of the other sidewall, so that, upon the turning down of the upper marginal section, after the folding in of the connecting walls, the rounded crease lines of the superimposed wall sections will engage matingly and close the bag air-tight.

6. A container according to claim 4, wherein the two layers of the sheet material form an aluminum-paper laminate, in which the aluminum layer is provided with pores, apertures or discontinuities and the paper has a highly absorbent inner layer with a substantially air-impermeable outer layer, so that the smoke and vapor precipitating in the closed container can be received through the openings or discontinuities of the aluminum layer into the absorbent paper intermediate layer but is unable to penetrate the air-impermeable outer layer.

7. A container according to claim 4, in which an aluminum layer is applied from a vapor or is atomized onto the inside of a support layer of paper.

8. A container according to claim 4, in which the pliable sheet material consists of an aluminum-plastic laminate.

9. A container according to claim 4, in which an elongated stripe of adhesive is disposed parallel and adjacent to the crease line on the sidewall, and in which a removable strip of protective film is adhered to the adhesive stripe.

* * * * *